United States Patent [19]

Hamisch, Jr.

[11] 4,163,422

[45] Aug. 7, 1979

[54] PRINT HEAD

[75] Inventor: Paul H. Hamisch, Jr., Franklin, Ohio

[73] Assignee: Monarch Marking Systems, Inc., Dayton, Ohio

[21] Appl. No.: 832,248

[22] Filed: Sep. 12, 1977

[51] Int. Cl.[2] ..... B41J 1/20

[52] U.S. Cl. ..... 101/111; 101/105

[58] Field of Search ..... 101/105, 111, 110, 109, 101/45

[56] References Cited

U.S. PATENT DOCUMENTS

| | | | |
|---|---|---|---|
| D. 238,205 | 12/1975 | Pabodie | D18/99 |
| 1,040,719 | 10/1912 | McClure | 101/111 |
| 1,346,912 | 7/1920 | Pitman | 101/111 |
| 3,933,092 | 1/1976 | Kirby | 101/105 |
| 3,968,745 | 7/1976 | Hamisch | 101/111 |
| 3,977,321 | 8/1976 | Pabodie | 101/111 |
| 4,023,485 | 5/1977 | Kirby | 101/111 |

*Primary Examiner*—Edward M. Coven

*Attorney, Agent, or Firm*—Joseph J. Grass

[57] ABSTRACT

There is disclosed a compact print head utilizing printing bands, coaxial drive wheels, a single selector for the drive wheels and support structure by which two or more lines of data can be printed on a record or other suitable surface.

9 Claims, 9 Drawing Figures

FIG-1
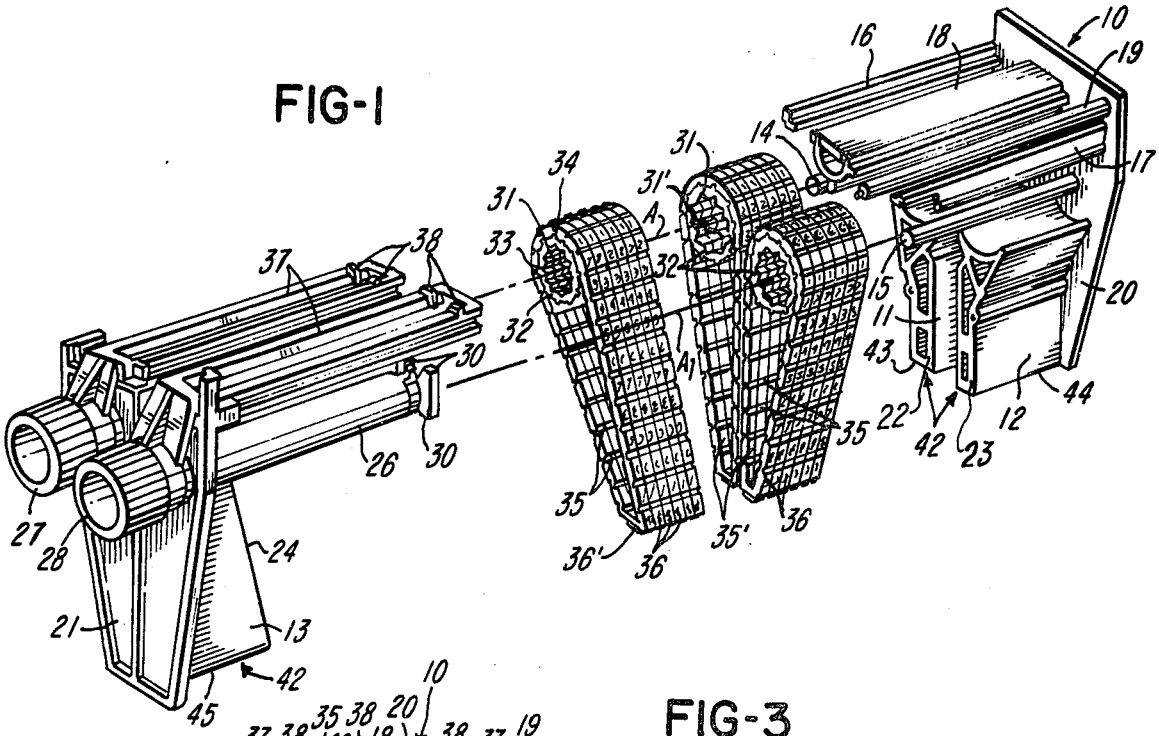
FIG-2
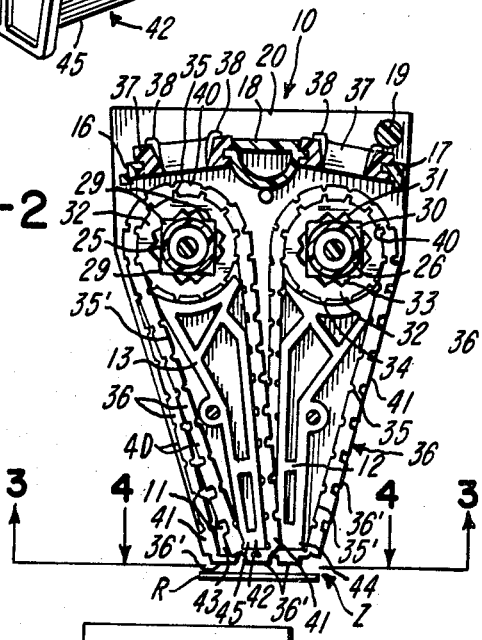
FIG-3
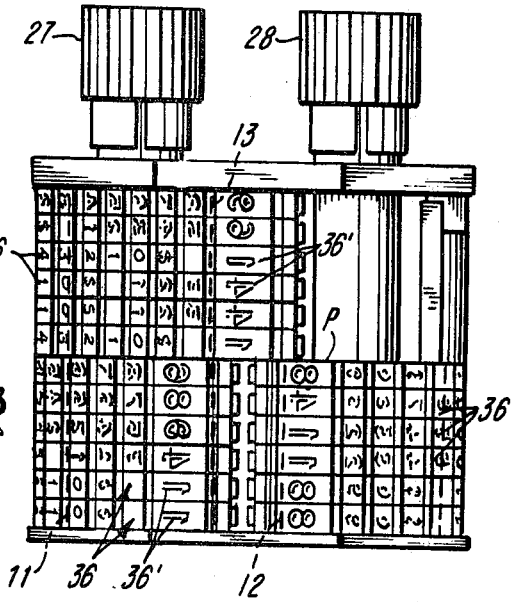
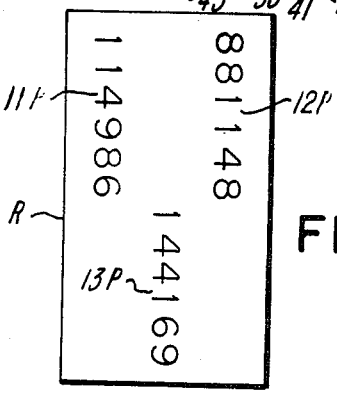
FIG-4

PRINT HEAD

BACKGROUND OF THE INVENTION

1. Field of the Invention

This invention relates to the art of print heads.

2. Summary of the Invention

The invention provides a compact print head for printing two or more lines of data using a plurality of coaxially mounted wheels and printing bands trained about the wheels and support structure. In one embodiment, the support structure includes support members and some printing bands are trained about respective wheels and one support member and other printing bands are trained about respective wheels and another support member. The support members are out of alignment with each other. In another embodiment, the support structure has a plurality of supporting stations and the printing band can be advanced to register with one station or another station. The supporting stations are out of alignment with each other. The invention is conducive to use of a single selector for driving any selected wheel.

BRIEF DESCRIPTION OF THE DRAWINGS

FIG. 1 is an exploded perspective view of a print head according to one embodiment of the invention;

FIG. 2 is a sectional view through the assembled print head;

FIG. 3 is a bottom plan view of the print head taken along line 3—3 of FIG. 2;

FIG. 4 is a top plan view of a record taken along line 4—4 of FIG. 2;

DETAILED DESCRIPTION OF THE PREFERRED EMBODIMENTS

Figure 5:
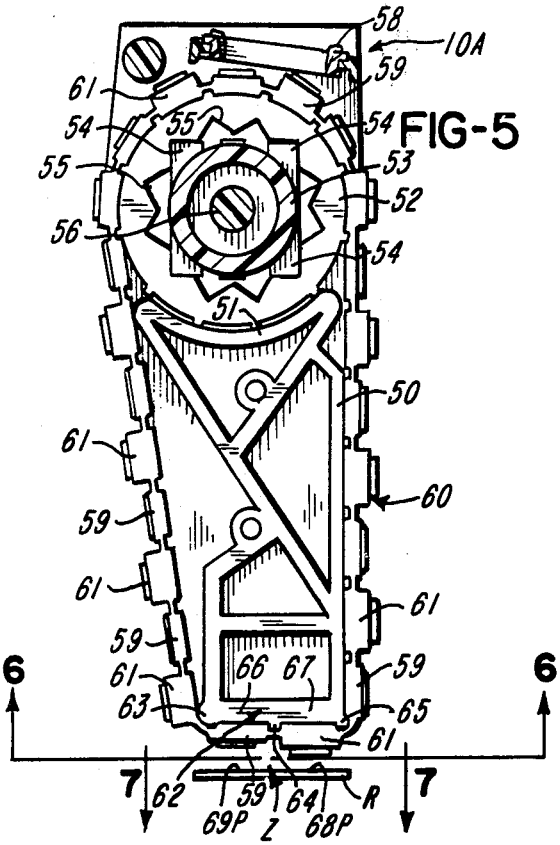
FIG. 5 is a sectional view of an alternative embodiment of a print head.
Figure 6:
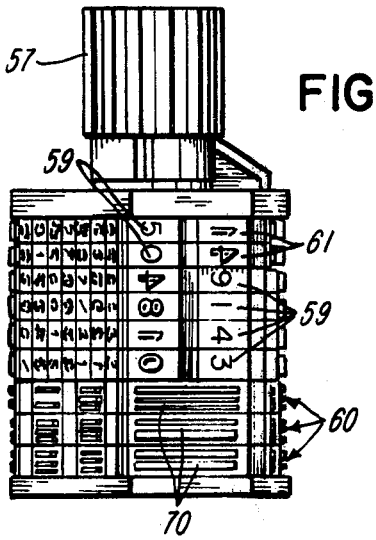
FIG. 6 is a bottom plan view taken along line 6—6 of FIG. 5.

With reference to the embodiment of FIGS. 1 through 3, and initially to FIG. 1, there is shown a print head generally indicated at 10 including print head frames 11, 12 and 13, a pair of posts 14 and 15, guides 16, 17 and 18 and a post 19. An end plate 20 is connected to frames 11 and 12, posts 14, 15 and 19 and guides 16, 17 and 18. The frame 13 is connected to an end plate 21. The end plates 20 and 21 are suitably connected to each other to provide a rigid framework. Terminal ends 22 and 23 of the respective frames 11 and 12 and terminal end 24 of the frame 13 lie in the same lateral plane P. Thus, the frames 11, 12 and 13 are longitudinally arranged but the frame 13 is laterally offset from or out of alignment with frames 11 and 12. A pair of axially shiftable and rotatable selectors 25 and 26 has respective knobs 27 and 28. The selectors 25 and 26 have lugs 29 and 30 which cooperate with respective notches 31 in drive wheels 32. As shown, each drive wheel 32 is of generally annular construction and has an internal hole 33. Peripheral lugs 34 which engage in corresponding notches 35 between lugs 35' on the underside of a respective printing band 36. Rectangular window members 37 having pointers 38 move longitudinally as a unit with respective selectors 25 and 26. The members 37 provide window openings through which characters on human readable portions 40 of each band 36 can be read. The human readable portion 40 of each band 36 is joined at its ends to a printing portion 41. The printing portion has printing blocks 36' with different printing elements. Additional details of the selectors, printing bands, and wheels are shown in U.S. Pat. No. 3,798,106, the disclosure of which is incorporated by reference.

The frames 11, 12 and 13 include support structure generally indicated at 42. The support structure 42 includes supports or anvils 43, 44 and 45 which provide respective supporting stations on respective frames 11, 12 and 13. The supports 43 and 44 extend parallel to each other in the longitudinal direction. The support 45 extends parallel to and is offset from or out of alignment with the supports 43 and 44. FIG. 3 shows the bands 36 supported by the respective frames 11, 12 and 13. Some of the bands 36 are shown trained about coaxial wheels 32 and the support 43 and others of the bands 36 which are shown trained about wheels that are on the same axis A are trained about the support 13. All the bands 36 which are trained about the wheels 32 which are mounted on axis A1 are trained about the support 44. The lines of printing bands 36 supported by frames 11, 12 and 13 are best shown to be offset in FIG. 3. With reference to FIG. 4, the print head 10 is shown to have produced the three lines of printing 11P, 12P and 13P on a record R. It is apparent that use of a single selector 25 cooperable with a set of coaxially mounted wheels 32 and a series of two longitudinally arranged supports 11 and 13 results in two laterally spaced lines of printing 11P and 13P. It is apparent that by use of this arrangement and a series of three or more longitudinally arranged but offset supports, three or more lines of printing can be printed on the record. As shown in FIG. 2, all the printing blocks 36' at the printing zone Z lie in a common plane. Moreover, each wheel 32 and its respective printing band 36 lie in a plane that is perpendicular to the respective support 43, 44 or 45.

Figure 7:
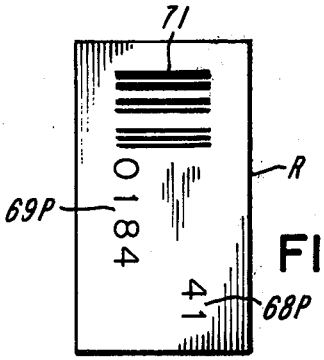
FIG. 7 is a top plan view of a record taken along line 7—7 of FIG. 5.
Figure 8:
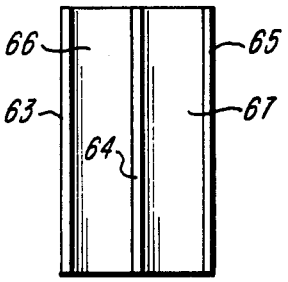
FIG. 8 is a bottom plan view of the support structure.
Figure 9:
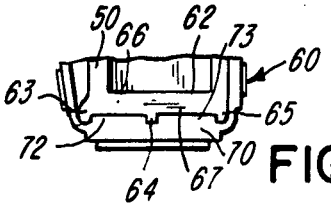
FIG. 9 is a fragmentary view showing a portion of the support structure and a portion of a printing band having a long printing block.

With respect to the embodiment of FIGS. 5, 6, 8 and 9, there is shown a print head 10A having a frame 50 having an arcuate surface 51 on which a series of coaxially aligned wheels 52 are rotatably mounted. A single selector 53 like the selector 25 has lugs 54 which engage in notches 55 in respective wheels 52. The shiftable and rotatable selector 53 is mounted on a post 56 and has a knob 57. The knob 57 is connected to a window 58 through which characters on human readable sections 59 of each printing band 60 can be seen. Each printing band 60 has a human readable section 59 between each printing section 61. The frame 50 has support structure generally indicated at 62. The support structure is illustrated to have three shallow ridges 63, 64 and 65 which define a pair of parallel supporting stations 66 and 67. By aligning the lugs 54 of the selector 53 with a selected wheel 52 and rotating the knob 57, the wheel is driven to advance the selected printing band 60 until a selected printing block 61 is brought into supported relationship at a printing zone Z in registry with the supporting station 66 or in registry with the supporting station 67. FIG. 5 shows a printing block 61 in supported relationship by supporting station 67. The human readable section 59 at the window will indicate the character which will be printed by the printing block 61 at the printing zone Z. The printing block 61 at the zone Z will thus print a character on the record R at a line of printing 68P. By rotating the knob 57, the printing band 60 can be advanced until the printing block 61 which is at the supporting station 67 is advanced to the supporting station 66, thus enabling the printing block 61 to print along a line of printing 69P. It is apparent that the human readable sections 59 are not as thick as the printing blocks 61 so the printing blocks 61 of the bands 60 which are at the printing zone Z will print data of the record R but the human readable sections 59 will not print on the record R. The human readable section 59 and the printing block 61 are thus not in the same plane at the printing zone Z. It is apparent that two lines of data can be printed even though only coaxially mounted wheels 52 are used and only a single selector is used. The support structure 62 can also function to support a printing band 60 having long printing blocks 70. Long printing blocks 70 are found to be especially useful when printing bar codes as indicated at 71 in FIG. 7. In the illustrated embodiment, the printing block 70 is shown to include two lugs 72 and 73 which are situated between the ridges 63 and 64, and 64 and 65. Thus, not only can the support structure 62 be used to provide two or more lines of printing 68P and 69P, the same support structure can be utilized to support a long printing block 70.

Other embodiments and modifications of this invention will suggest themselves to those skilled in the art, and all such of these as come within the spirit of this invention are included within its scope as best defined by the appended claims.

I claim:

1. A compact print head, comprising: a plurality of coaxially mounted wheels, a support having a plurality of supporting stations, and a plurality of printing bands, each printing band having a plurality of different printing elements, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

2. A compact print head, comprising: a plurality of coaxially mounted wheels, a single manually operable selector for rotating any selected wheel, a support having a plurality of supporting stations, a plurality of printing bands, each printing band having a plurality of different printing elements, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

3. A compact print head comprising: a plurality of coaxially mounted wheels, a stationary support having a plurality of supporting stations, a plurality of printing bands, each printing band having a plurality of different printing elements, the printing band having a human readable character adjacent each printing element, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

4. A compact print head comprising: a plurality of coaxially mounted wheels, a stationary support having a plurality of supporting stations, a plurality of printing bands, each printing band having a plurality of different printing elements, the wheels having a plurality of notches at their outer peripheries, a lug at the underside of each printing element, a notch at each supporting station of the support, the lugs being engageable with the respective wheel and being registerable with the notch of any supporting station, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

5. A compact print head, comprising: a plurality of coaxially mounted wheels, a stationary support having a plurality of supporting stations, a plurality of printing bands, each printing band having a plurality of different printing elements, each printing band having a human readable character adjacent each printing element, the wheels having a plurality of notches at their outer peripheries, a lug at the underside of each band at each human readable character, a notch at each supporting station of the support, the lugs being engageable with the respective wheel and being registerable with the notch of any supporting station.

6. A compact print head comprising: a plurality of coaxially mounted wheels, a stationary support having a plurality of supporting stations, a plurality of printing bands, each printing band having a plurality of different printing elements, each printing band having a human readable character adjacent each printing element and a lug at the underside of the band at each human readable character, the wheels having a plurality of notches at their outer peripheries, a lug at the underside of each printing element, a notch at each supporting station of the support, the lugs being engageable with the respective wheel and being registerable with the notch of any supporting station, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

7. A compact print head comprising: a plurality of coaxially mounted wheels, a single manually operable selector for rotating any selected wheel, a stationary support having a plurality of supporting stations, a plurality of printing bands, each printing band having a plurality of different printing elements, a human readable character adjacent each printing element and a lug at the underside of the band at each human readable character and each printing element, the wheels having a plurality of notches at their outer peripheries, a notch at each supporting station of the support, the lugs being engageable with the respective wheel and being registerable with the notch of any supporting station, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

8. A compact print head comprising: a plurality of coaxially mounted wheels, a stationary support having a plurality of supporting stations, a plurality of printing bands, each printing band having a plurality of different printing elements, a human readable character adjacent each printing element and a lug at the underside of the band at each human readable character and each printing element, a single manually operable selector for rotating any selected wheel, wherein the human readable characters have a lesser height than the printing elements, the wheels having a plurality of notches at their outer peripheries, a notch at each supporting station of the support, the lugs being engageable with the respective wheel and being registerable with the notch of any supporting station, each printing band being trained about a wheel and the support and at least some of the printing elements being selectively registerable with any one of the supporting stations, the printing elements lying in the same plane irrespective of the supporting station with which they are registered, whereby the print head can print at least two lines of data.

9. A compact print head comprising: a plurality of coaxially mounted wheels, a stationary support having a plurality of supporting stations, a plurality of printing bands, each printing band having a plurality of different printing elements, the wheels having a plurality of notches at their outer peripheries, a lug at the underside of each printing element, a notch at each supporting station of the support, the lugs being engageable with the respective wheel and being registerable with the notch of any supporting station, each printing band being trained about a wheel and the support and at least some of the printing elements being selectively registerable with any one of the supporting stations, the printing elements lying in the same plane irrespective of the supporting station with which they are registered, whereby the print head can print at least two lines of data, wherein some of the printing elements are registerable simultaneously with more than one supporting station.

* * * * *